US005564295A

United States Patent [19]

Weinerman et al.

[11] Patent Number: 5,564,295

[45] Date of Patent: *Oct. 15, 1996

[54] HANDLE OPERABLE ROTARY LATCH AND LOCK

[75] Inventors: Lee S. Weinerman, Medina; Arthur J. Kuminski, Parma; James L. Hollingsworth, Middleburg Heights; Scott A. Arthurs, Brunswick, all of Ohio

[73] Assignee: The Eastern Company, Cleveland, Ohio

[ * ] Notice: The term of this patent shall not extend beyond the expiration date of Pat. No. 5,439,260.

[21] Appl. No.: 510,470

[22] Filed: Aug. 2, 1995

Related U.S. Application Data

[63] Continuation of Ser. No. 145,691, Oct. 29, 1993, Pat. No. 5,439,260.

[51] Int. Cl.[6] ..... E05C 3/26

[52] U.S. Cl. ..... 70/208; 70/472; 292/48; 292/216; 292/337; 292/341.12

[58] Field of Search ..... 292/48, 216, 341.12, 292/143, 342, 147, 74, 173, 337, 280, 336.3, 337, DIG. 14, DIG. 39, DIG. 51; 70/208, 134, 144, 472

[56] References Cited

U.S. PATENT DOCUMENTS

| | | | |
|---|---|---|---|
| D. 303,349 | 9/1989 | Weinerman et al. | D8/331 |
| D. 304,291 | 10/1989 | Weinerman et al. | D8/331 |
| D. 311,323 | 10/1990 | Weinerman et al. | D8/331 |
| D. 316,366 | 4/1991 | Hansen et al. | D8/331 |
| D. 319,001 | 8/1991 | Weinerman et al. | D8/331 |
| 4,312,203 | 1/1982 | Davis | 70/472 |
| 4,320,642 | 3/1982 | Pastva, Jr. | 70/472 |
| 4,703,961 | 11/1987 | Weinerman et al. | 292/216 |
| 4,892,338 | 1/1990 | Weinerman et al. | 292/35 |
| 4,896,906 | 1/1990 | Weinerman et al. | 292/48 |
| 4,917,412 | 4/1990 | Swan et al. | 292/48 |
| 5,069,491 | 12/1991 | Weinerman et al. | 292/48 |

*Primary Examiner*—Steven N. Meyers
*Assistant Examiner*—Tuyet-Phuong Pham
*Attorney, Agent, or Firm*—David A. Burge, Esq.

[57] ABSTRACT

A slam-capable rotary latch employs a single rotary jaw that is releasably retained in its latched position by a rotary pawl, with the latch having a pair of spaced housing side plates that sandwich the rotary jaw and the rotary pawl, with the side plates defining aligned first and second U-shaped notches that cooperate with a third U-shaped notch formed in the rotary jaw for concurrently receiving and latchingly retaining within the confines of the first, second and third U-shaped notches a suitably configured strike formation, with housing side plate portions that define a selected one of the first and second U-shaped notches being rigidified and strengthened by the close proximity presence to the selected U-shaped notch of a flange 1) that is formed integrally with the side plate portions that define the selected U-shaped notch, 2) that is connected by a tight radius bend to the side plate portions that define the selected U-shaped notch, and 3) that extends transversely so as to bridge between the pair of housing side plates.

10 Claims, 9 Drawing Sheets

HANDLE OPERABLE ROTARY LATCH AND LOCK

CROSS REFERENCE TO RELATED APPLICATION

The present application is a continuation of application Ser. No. 08/145,691 filed Oct. 29, 1993 by Lee S. Weinerman et al, issued Aug. 8, 1995 as U.S. Pat. No. 5,439,260, referred to hereinafter as the "Parent Case," the disclosure of which is incorporated herein by reference.

BACKGROUND OF THE INVENTION

1. Field of the Invention

The present invention relates to novel and improved slam-capable rotary latches and locks that typically are used in industrial cabinetry applications, that can be operated by a wide variety of commercially available latch and lock operating mechanisms. More particularly, the present invention relates to a rotary latch that employs a single rotary jaw that is releasably retained in its latched position by a rotary pawl, with the latch having a pair of spaced housing side plates that sandwich the rotary jaw and the rotary pawl, with the side plates defining aligned first and second U-shaped notches that cooperate with a third U-shaped notch formed in the rotary jaw to concurrently receive and latchingly retain within the confines of the first, second and third U-shaped notches a suitably configured strike formation, with housing side plate portions that define a selected one of the first and second U-shaped notches being rigidified and strengthened by the close proximity presence of a flange 1) that is formed integrally with the side plate portions that define the selected U-shaped notch, 2) that is connected by a tight radius bend to the side plate portions that define the selected U-shaped notch, and 3) that extends transversely so as to bridge between the pair of housing side plates.

2. Prior Art

Flush mountable, paddle-handle operated latches and locks are known that employ rotary latch bolts, also referred to as "rotary jaws," wherein the jaws are provided with U-shaped strike-receiving notches for latchingly receiving and releasably retaining suitably configured strike formations. Disclosures of latch and/or lock units of this type are found in U.S. Pat. No. 4,320,642 issued Mar. 23, 1982 to John V. Pastva, Jr., entitled PADDLE LOCKS WITH HANDLE DISCONNECT FEATURES; U.S. Pat. No. 4,917,412 issued Apr. 17, 1990 to Jye P. Swan et al, entitled VEHICLE DOOR LOCK SYSTEM PROVIDING A PLURALITY OF SPACED ROTARY LATCHES; U.S. Pat. No. 4,896,906 issued Jan. 30, 1990 to Lee S. Weinerman et al entitled VEHICLE DOOR LOCK; and, U.S. Pat. No. 5,069,491 issued Dec. 3, 1991 to Lee S. Weinerman et al entitled VEHICLE DOOR LOCK SYSTEM. The disclosures of these four U.S. patents are incorporated herein by reference.

The rotary latch and/or lock units that are disclosed in the four patents identified above are of a relatively heavy duty type that often are employed in "personnel restraint applications," typically on doors of passenger compartments of vehicles. These heavy duty units employ pairs of housing-mounted rotary jaws, with the jaws being sandwiched between pairs of housing side plates, and with notches that are formed in each pair of rotary jaws being configured to receive and engage opposite sides of a suitably configured strike formation, typically a cylindrical stem of a striker pin. While both of the housing side plates are provided with U-shaped notches, neither of these notches defines a strike engagement surface that cooperates with a notched rotary jaw to latchingly receive and releasably retain a strike formation. The notches that are formed in the jaws, not the notches that are formed in the housing side plates, receive, engage and latchingly retain suitably configured strike formations.

Lighter duty rotary latch and lock units that employ single rotary jaws also are known. For example, U.S. Pat. No. 4,312,203 issued Jan. 26, 1982 to Edwin W. Davis entitled FLUSH-MOUNTABLE LOCK WITH ACTUATOR DISCONNECT FEATURE discloses 1) the use of a single rotary latch jaw that is nested within and supported by portions of the housing of a flush mountable paddle-handle assembly, and 2) the use of a single U-shaped housing-carried notch that cooperates with the U-shaped notch formed in a rotary jaw to receive and latchingly retain a generally cylindrical strike formation. The disclosure of this patent is incorporated herein by reference.

3. The Parent Case

The above-referenced "Parent Case" is directed to an improved form of slam-capable rotary latch that is bracket mounted and handle operated. The present continuation case is directed to slam-capable rotary latch features that are not necessarily "integrated into" and are not necessarily "associated with" particular forms of latch and lock operating mechanisms.

SUMMARY OF THE INVENTION

Not addressed by the patents that are identified above (i.e., by such patents as constitute "prior art" to the referenced "Parent Case") is the need for a relatively light duty rotary latch that employs only a single rotary jaw instead of a pair of rotary jaws, that employs first and second housing side plates that define, respectively, first and second notches that are of generally U-shape, with the first and second U-shaped notches being positioned and aligned for cooperating with a third U-shaped notch that is formed in the single rotary jaw to receive and latchingly retain within the confines of the first, second and third notches a suitably configured strike formation, and with the latch making advantageous use of a transversely extending flange that is formed integrally with one of the first and second housing side plates to rigidify and strengthen housing side plate portions that define a strike-engaging surface of at least one of the aligned first and second U-shaped notches. Features of the present invention address this need.

Also not addressed by the patents that are identified above (i.e., by such patents as constitute "prior art" to the referenced "Parent Case") is a need for a slam-capable, relatively light duty rotary latch and/or lock assembly that is well suited for use with a wide variety of commercially available operating mechanisms, that employs a single rotary jaw having a U-shaped notch formed therein that cooperates with a pair of housing side plates that define an aligned pair of U-shaped notches for cooperating with the notch formed in the rotary jaw to concurrently receive and latchingly retain within the confines of the three U-shaped notches a suitably configured strike formation, and that utilizes a stamped metal bracket 1) to assist in securely mounting the handle and housing assembly on a closure, 2) to assist in mounting the rotary lock assembly on a closure, and 3) to mount movable elements of an operating linkage that interconnects the handle and housing assembly with the rotary latch assembly for operating the latch (to release the rotary jaw from cooperating with the aligned U-shaped notches that are formed housing side plates) to "unlatch" the strike formation. Features of the present invention address this need.

A rotary latch assembly that embodies the preferred practice of the present invention includes an elongate, generally rectangular first housing side plate having opposed end regions near opposite ends of the length thereof, and defining a first U-shaped notch located near one of the opposed end regions of the first housing side plate; an elongate, generally rectangular second housing side plate having opposed end regions near opposite ends of the length thereof, and defining a second U-shaped notch located near one of the opposed end regions of the second housing side plate, with the second U-shaped notch being configured to substantially align with the first U-shaped notch; spacer means for extending transversely between, for rigidly connecting with, and for holding in substantially parallel relationship the first and second housing side plates, with the spacer means including a first spacer that extends along a first transverse axis that intersects each of the first and second housing side plates at a location that is relative near to the other end regions thereof, and with the spacer means also including a second spacer that extends along a second transverse axis that intersects each of the first and second housing side plates at a location that is substantially midway between the opposite ends thereof; with the rotary latch bolt means including a rotary jaw and a rotary pawl that extend substantially within a common plane located between the first and second housing side plates, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with an operating arm being provided for moving the rotary pawl to release the rotary jaw from its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation, and with a selected one of the first and second housing side plates being strengthened and enhanced in rigidity by the close proximity presence of a transversely extending flange that is formed integrally with the selected housing side plate.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

Figure 1:
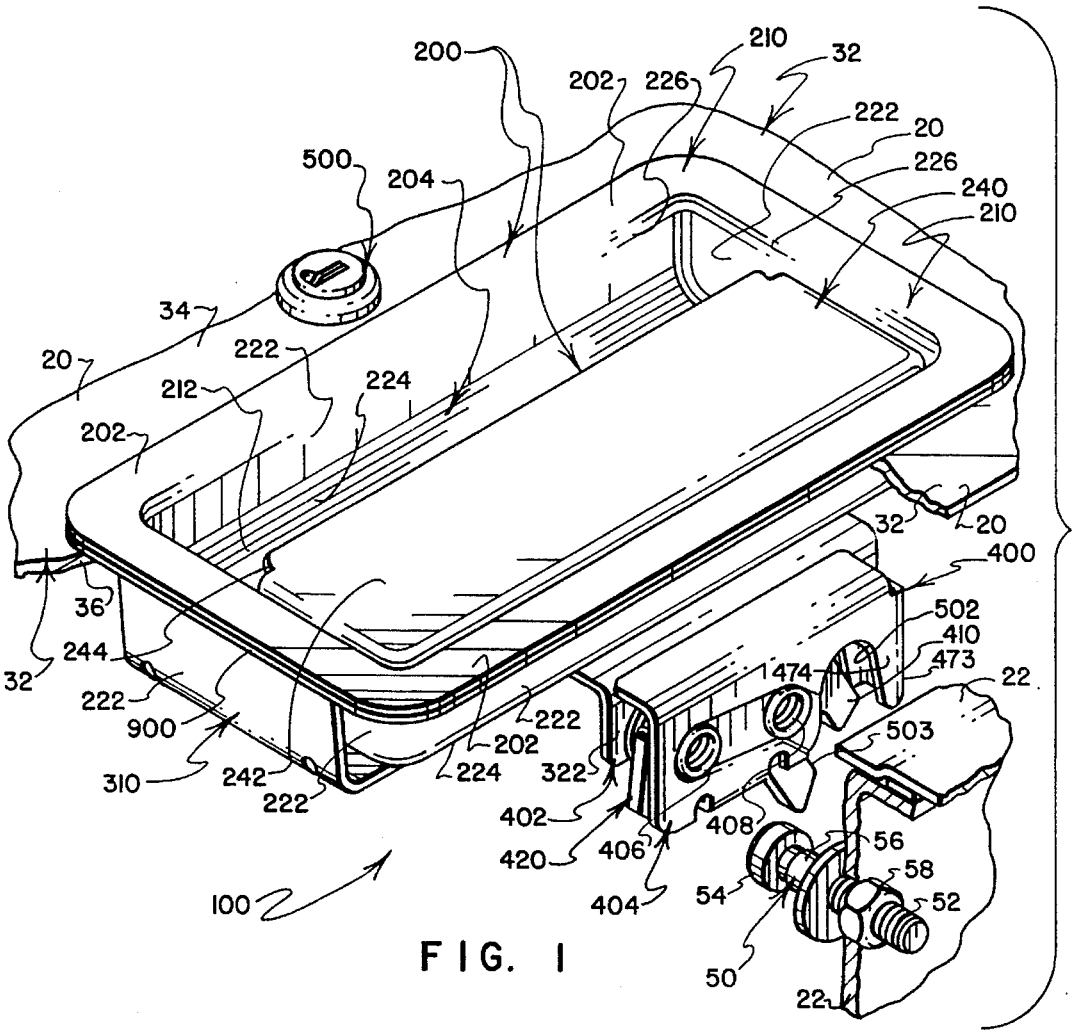
FIG. 1 is front perspective view of a rotary latch and lock unit that embodies features of the preferred practice of the present invention, shown in combination with a handle operating mechanism, which combination embodies features of the preferred practice of the invention of the Parent Case as installed on a closure of a cabinet and being operable to latchingly engage a strike that is installed on a part of the cabinet that is situated near the closure when the closure is closed, with an operating handle shown in its non-operated position, with a rotary jaw shown in its unlatched position ready to be slammed into latching engagement with the strike, and with portions of the cabinet and closure being broken away.

In the description that follows, the discussion that is associated with FIGS. 1–15 relates to a rotary lock embodiment that employs what will be referred to as a "rotary latch subassembly" 400. The discussion that is associated with FIGS. 16–19 relates to four alternate embodiments of rotary latch subassemblies, designated (in FIGS. 16–19) by the numerals 1400, 2400, 3400, 4400, respectively. The rotary latch subassemblies 400, 1400, 2400, 3400 and 4400 represent the best modes known to the applicants for carrying out the preferred practice of the present invention.

Because most of the components that comprise the alternate latch subassembly embodiments 1400, 2400, 3400, 4400 have corresponding components (indeed, often "identically configured" corresponding components) that will be described in some detail in conjunction with the rotary latch subassembly 400, "corresponding numerals" have been used to designate corresponding components. By utilizing corresponding numerals to designate corresponding (often "identically configured") components, the description of component features and functions that is presented in conjunction with the subassembly embodiment 400 will be understood to have corresponding applicability to component features and functions of the subassembly embodiments 1400, 2400, 3400, 4400—hence a need that might otherwise exist to repetitively describe component features and functions of components of the subassembly embodiments 1400, 2400, 3400, 4400 is obviated.

Corresponding components of the subassembly embodiments 1400, 400 bear "corresponding numerals" that differ by a magnitude of one thousand. Thus, it will be understood that the operating arm 1450 of the subassembly 1400 corresponds to the operating arm 450 of the subassembly 400. Likewise, corresponding components of the subassembly embodiments 2400, 3400, 4400 bear numerals that "correspond" with numerals used to identify components of the subassembly embodiment 400—except that 1) the numerals used with the embodiment 2400 differ by a magnitude of two thousand from the numerals used with the embodiment 400, 2) the numerals used with the embodiment 3400 differ by a magnitude of three thousand from the numerals used with the embodiment 400, and 3) the numerals used with the embodiment 4400 differ by a magnitude of four thousand from the numerals used with the embodiment 400. Whereas the subassembly 400 is integrated into (and provides essential component parts of) a "rear mountable modular assembly" 300 of the rotary latch and lock unit 100, the subassembly embodiments 1400, 2400, 3400, 4400 are not depicted as being "integrated into" or as being otherwise "associated with" particular forms of latch and lock operating mechanisms. The operating arms 1450, 2450, 3450, 4450 of the subassembly embodiments 1400, 2400, 3400, 4400 are not depicted as being engaged by any particular form of operating linkage for, as those who are skilled in the art will readily understand, the depicted operating arms 1450, 2450, 3450, 4450 can be operated either directly by hand or by power actuator (not shown), indirectly by hand or by actuator through the use of a wide variety of known forms of connecting linkage (not shown), and/or through the use of a wide variety of commercially available operating handle assemblies (not shown).

Referring to FIGS. 1–11, a handle operable rotary latch and lock unit 100 is shown mounted on a cabinet door or closure 20. The door 20 typically is formed from a stamped metal sheet 32, or as an assembly of plural metal sheets (not shown). The door 20 is movable between open and closed positions with respect to adjacent cabinet structure 22, portions of which are depicted in FIGS. 1, 5, 8 and 11.

Figure 7:
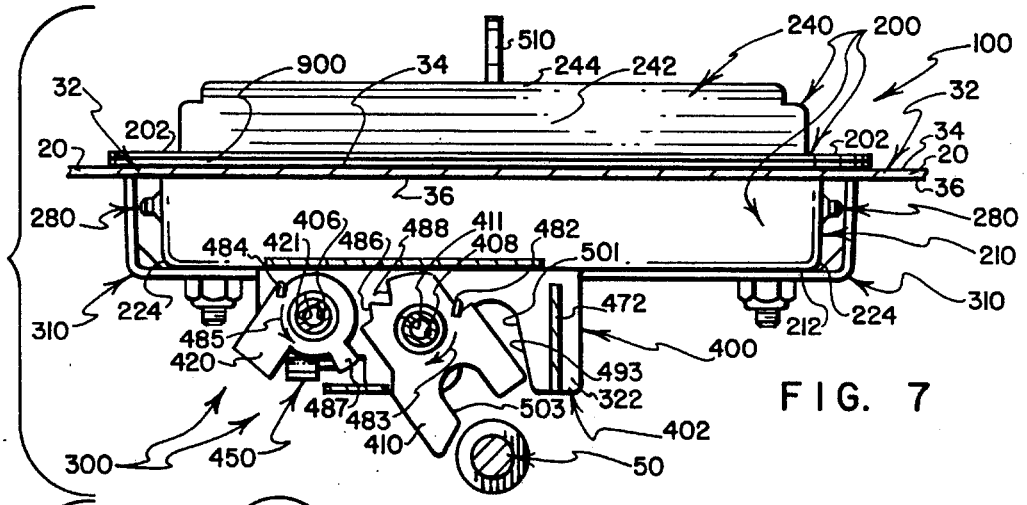
FIGS. 7 and 8 are sectional views as seen from planes indicated by lines 7—7 and 8—8 in FIG. 6, with relatively movable components of the unit positioned as is depicted in FIG. 6, and with the strike disengaged from the rotary jaw.

Mounted on the cabinet structure 22 is a strike 50 (best seen in FIGS. 1, 7, 8 and 12). While a strike that is suitably configured for use with the rotary latch and lock unit 100 can take a wide variety of forms, the elongate, "headed and threaded pin" form of strike that is depicted in FIGS. 1, 7, 8 and 12 ordinarily is preferred. Near one end of the strike 50, threads 52 are formed. The opposite end of the strike 50 takes the form of an enlarged diameter head 54. A generally cylindrical central region 56 is interposed between the threads 52 and the head 54, and provides an example of what is referred to herein as a "suitably configured strike formation." The cylindrical central region 56 1) is "slammable" into latching engagement with the rotary jaw 410 (when the rotary jaw 410 is "unlatched," as is best seen in FIGS. 1 and 7), 2) is receivable within a U-shaped notch 503 of the rotary jaw 410 (see, for example, FIGS. 2, 4 and 10), and 3) cooperates with the rotary jaw 410 to latch the door 20 in its closed position (see FIGS. 2, 4 and 5).

Figure 8:
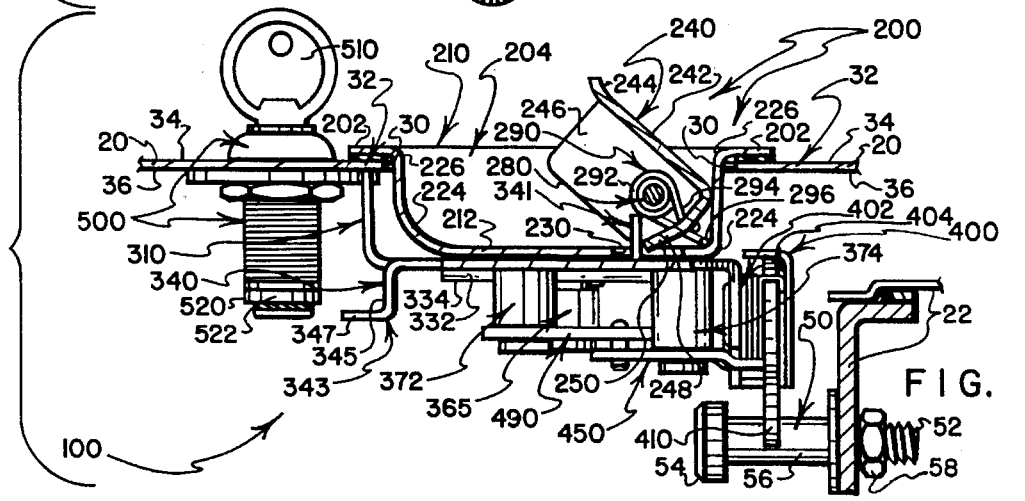
Figure 9:
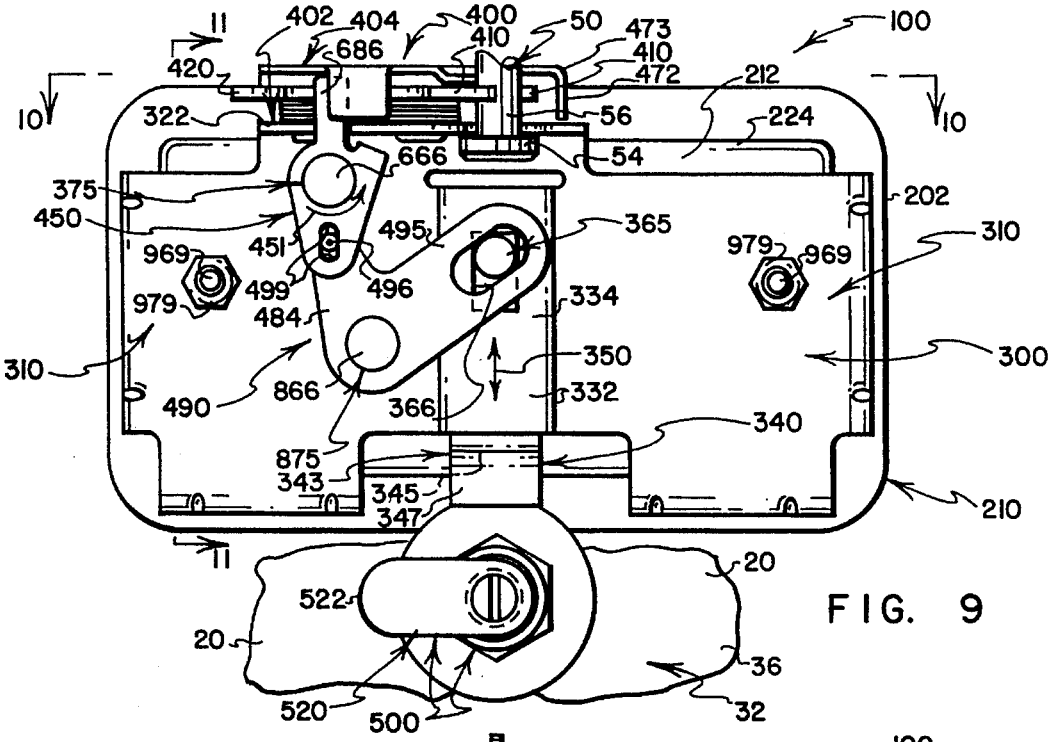
FIG. 9 is a bottom plan view similar to FIG. 6 but with the unit's rotary jaw in a preliminary stage of latching engagement that is experienced by the unit as the closure is moved toward its fully closed position.
Figure 10:
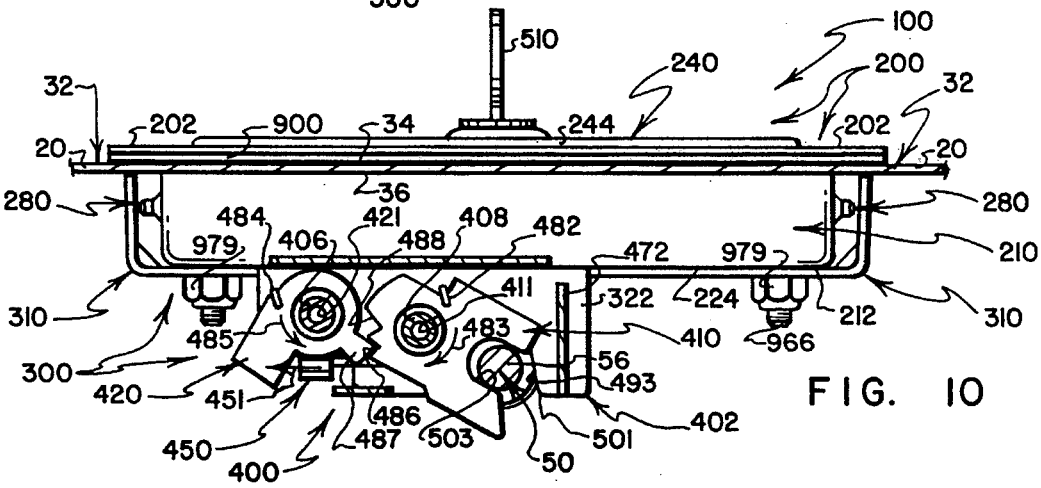
FIGS. 10 and 11 are sectional views as seen from planes indicated by lines 10—10 and 11—11 in FIG. 9, with relatively movable components of the unit positioned as is depicted in FIGS. 4 and 5 except for the angular positions of the rotary jaw and pawl of the unit.
Figure 11:
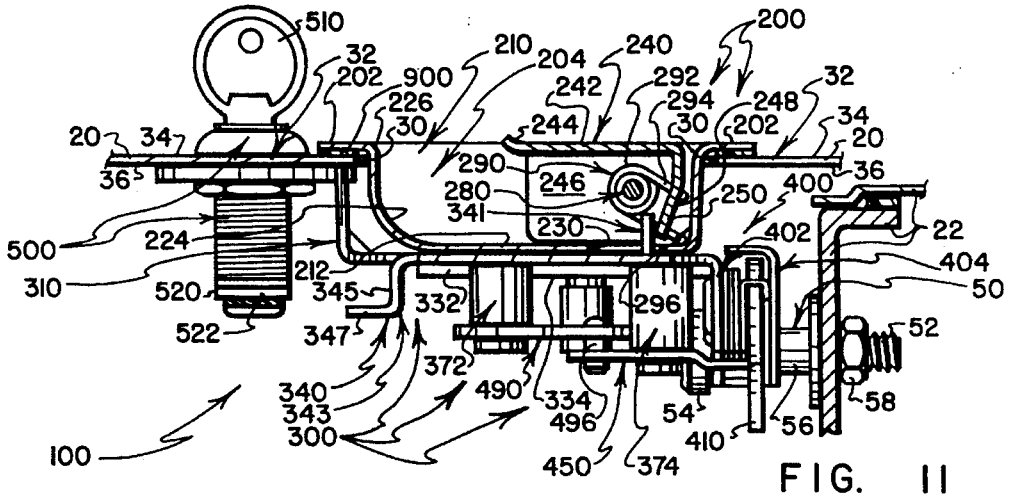

One of many possible "open" positions of the door 20 is depicted in FIG. 1, with another possible "open" position being depicted in FIGS. 7 and 8—wherein a rotary jaw 410 of the unit 100 is shown "unlatched" (i.e., not being retained by the rotary jaw 410) and ready to be slammed into latching engagement with a strike 50 that is mounted on the cabinet structure 22. The "closed" position of the door 20 is depicted in FIG. 2–5—wherein the rotary jaw 410 is shown receiving and latchingly retaining a generally cylindrical portion 56 of the strike 50. A "nearly closed" or "preliminarily latched" position of the door 20 is depicted in FIG. 9–11—wherein the rotary jaw 410 is shown latchingly retaining the strike portion 56 to a sufficient degree that operation of the handle 240 is required to release a rotary pawl 420 from engaging the rotary jaw 410 to cause the spring-biased rotary jaw 410 to move from its "partially latched" position (best seen in FIG. 10) toward its unlatched position (best seen in FIG. 7).

Figure 12:
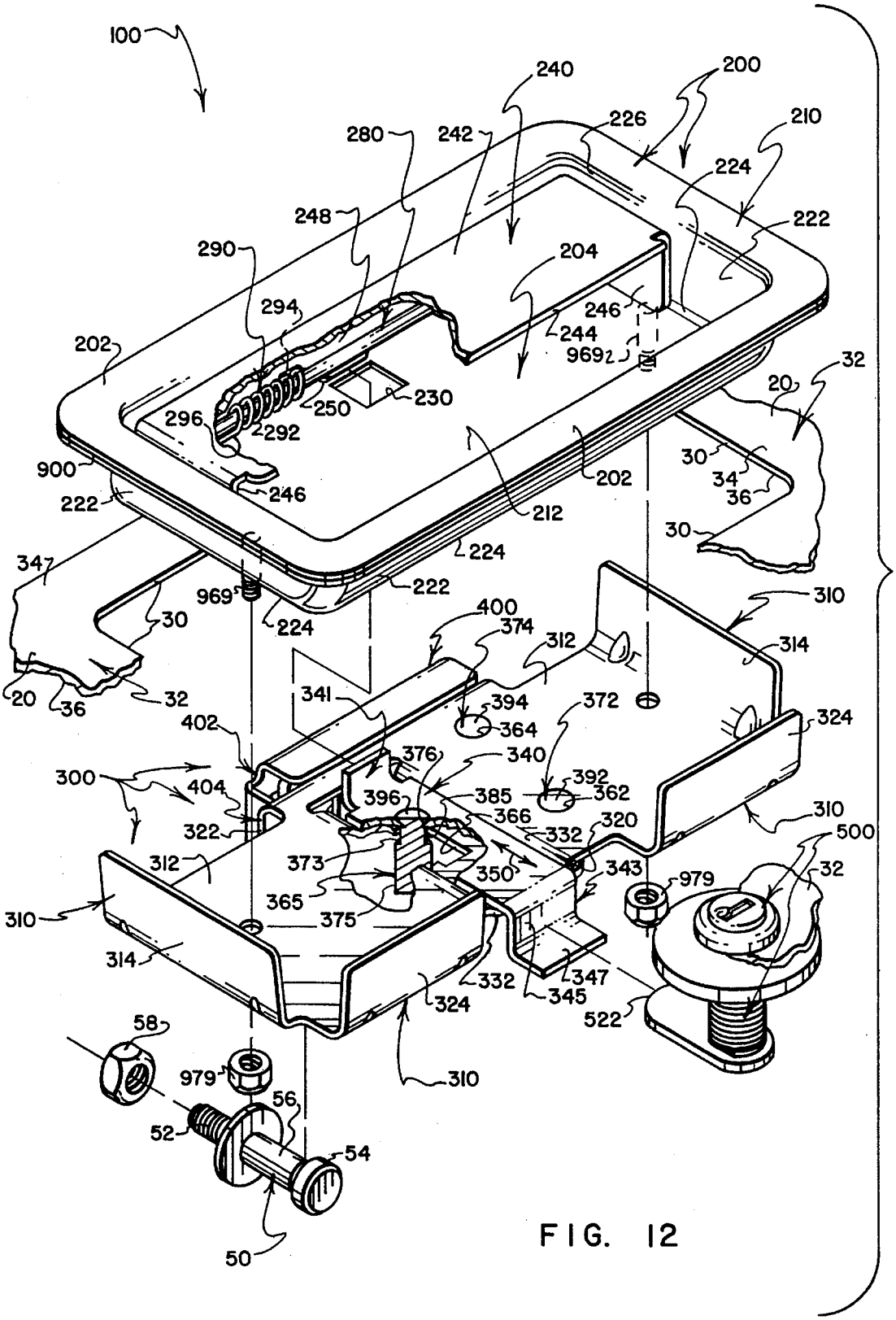
FIGS. 12, 13 and 14 are exploded front perspective views of selected components of the rotary latch and lock unit of FIGS. 1–11, with some components separated so as to be depicted individually, with other components shown assembled, and with some component portions broken away to permit underlying features to be viewed.
Figure 13:
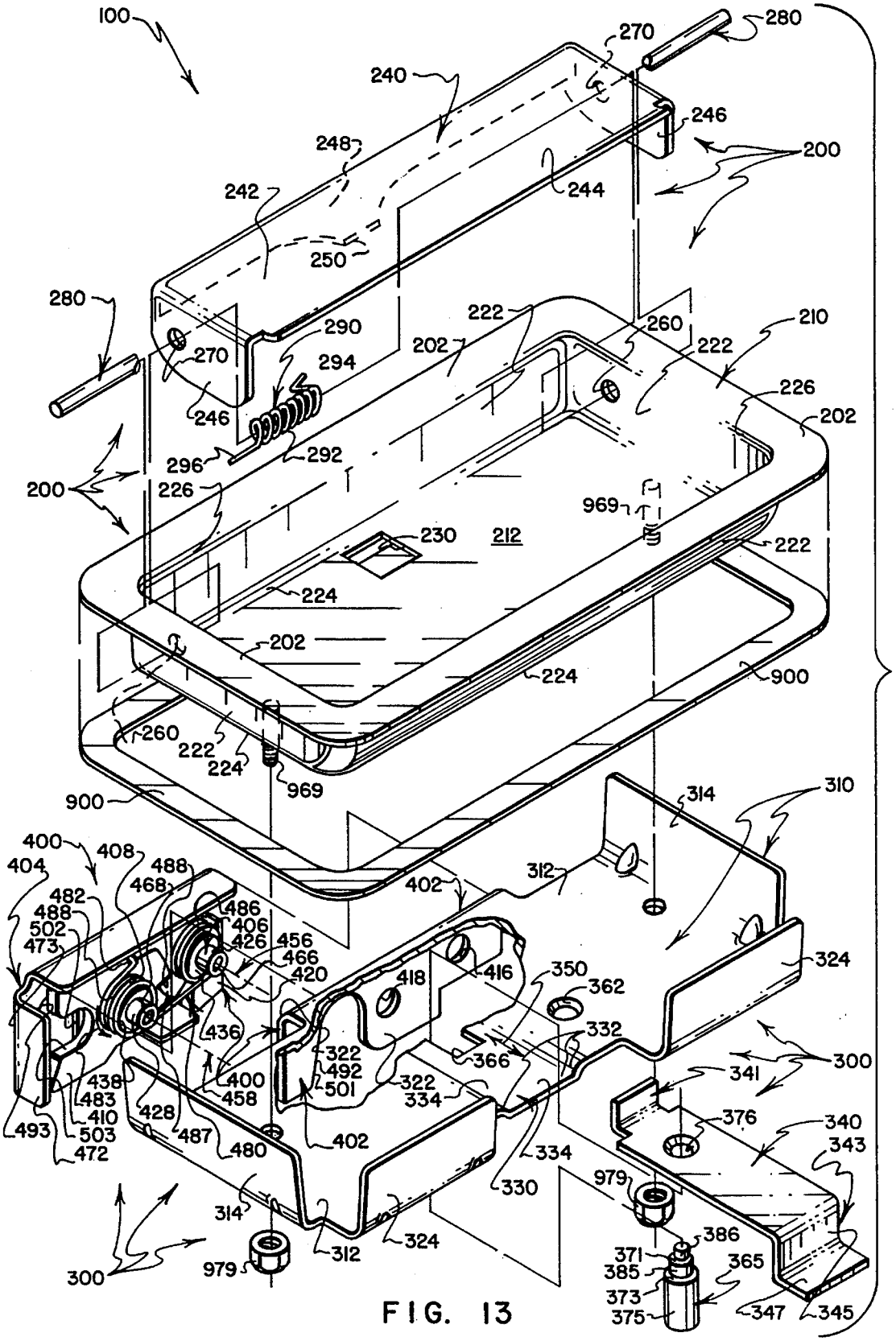
Figure 14:
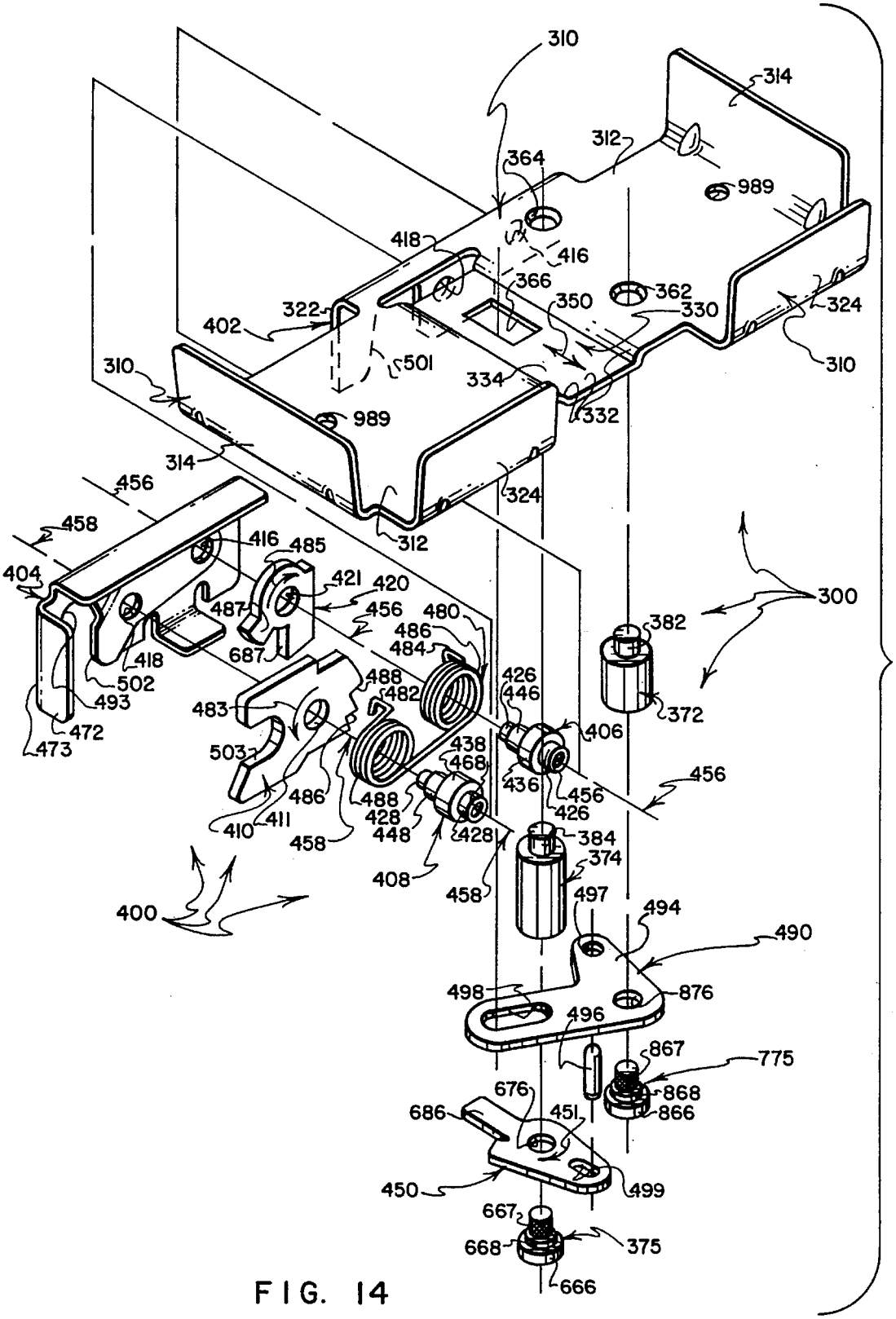

Three modular assemblies 200, 300, 500 form the latch and lock unit 100. Referring to FIGS. 12 and 13, a pan-shaped housing 210, a paddle-shaped handle 240, a hinge pin 280, and a torsion coil spring 290 comprise what will be referred to as a "front mountable modular assembly" or "handle and housing assembly" 200. Referring to FIGS. 12–14, a mounting bracket 310, a slide 340, a rotary latch subassembly 400, and linkage components 490 that drivingly interconnect the slide 340 with the operating arm 450 of the latch subassembly 400 comprise what will be referred to as a "rear mountable modular assembly" or "bracket, latch and linkage assembly" 300. Referring to FIG. 12, a "third modular assembly" takes the form of a conventional, commercially available, "key operated cam lock assembly" 500 that can be operated by a suitably configured key 510 (see FIGS. 4, 5, 7, 8 and 10 wherein the bow of such a key 510 is shown projecting forwardly from the cam lock assembly 500).

Turning to features of the "front mountable modular assembly" or "handle and housing assembly" 200, and referring to FIGS. 1, 10, 12 and 13, the pan-shaped housing 210 is a generally rectangular metal stamping having a perimetrically extending mounting flange 202 which surrounds a forwardly facing recess 204. A back wall 212 closes the back of the recess 204. Side walls 222 are joined by bends 224 to the perimeter of the back wall 212, and by bends 226 to the interior of the mounting flange 202. An opening 230 is formed through the back wall 212.

Referring principally to FIGS. 12 and 13, the paddle-shaped handle 240 has a generally rectangular front wall 242 with a forwardly-turned lip 244 formed along one edge. Rearwardly-turned flanges 246 border opposite ends of the rectangular front wall 242. A rearwardly extending formation 248 joins with the rectangular front wall 242 along an edge that is opposite the lip 244, and defines a tab 250 that extends toward the back wall opening 230.

Referring to FIG. 13, the hinge pin 280 extends through aligned holes 260 that are formed through an opposed pair of the side walls 222 of the pan-shaped housing 210, and through aligned holes 270 that are formed through the rearwardly-turned flanges 246 of the paddle-shaped handle 240 to pivotally mount the handle 240 on the housing 210. Referring to FIGS. 12 and 13, the torsion coil spring 290 has a coiled central region 292 that extends loosely about the hinge pin 280 at a location between the rearwardly-turned flanges 246 of the handle 240, and has opposed end regions 294, 296. Referring to FIG. 5, 8, 11 and 12, the end region 294 extends into engagement with the formation 248 of the paddle handle 240; and the end region 296 extends into engagement with the back wall of the pan-shaped housing 210. By this arrangement, it will be understood that the torsion coil spring 290 is "interposed between" the housing 210 and the handle 240 in a manner that permits the spring 290 to bias the handle 240 away from its "extended" or "operated" position (see FIGS. 7 and 8) toward its "nested" or "non-operated" position (see FIGS. 1, 5 and 12).

Figure 5:
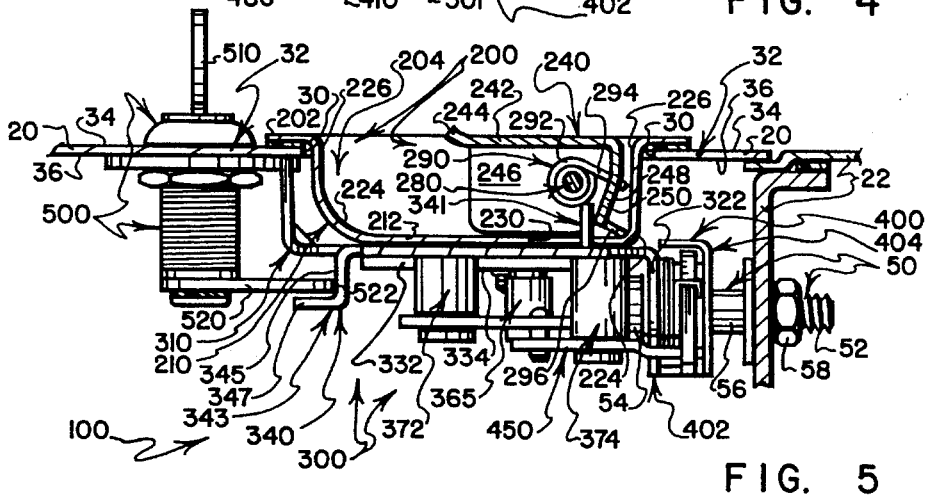
Figure 6:
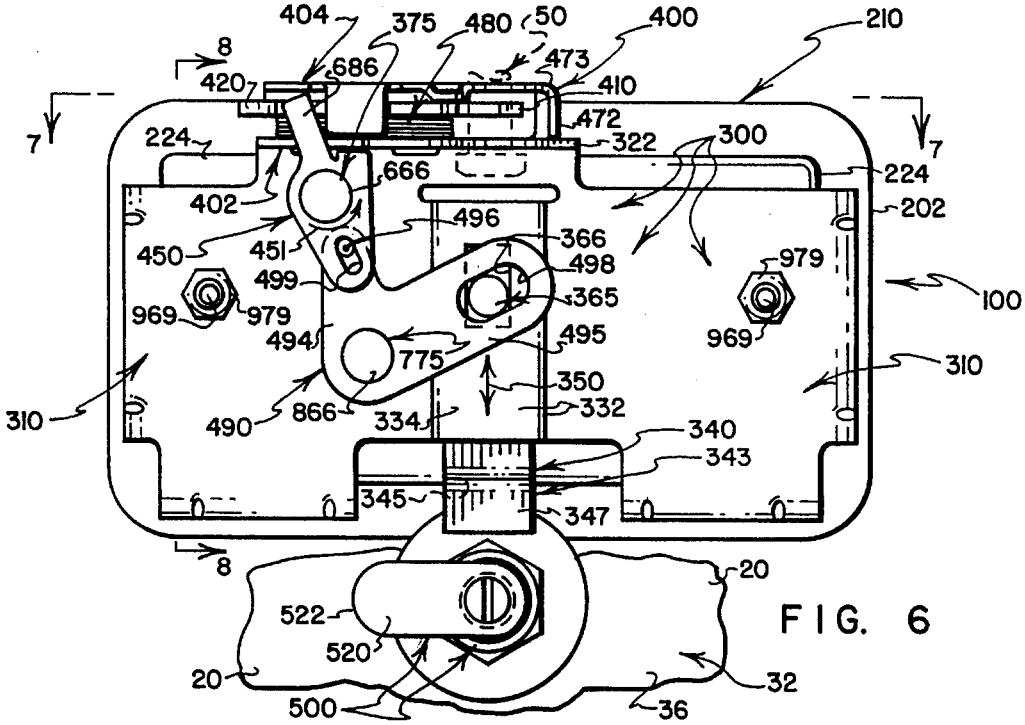
FIG. 6 is a bottom plan view similar to FIG. 3 but with the unit's lock cylinder unlocked, with the unit's operating handle in an operated position that causes the unit's linkage to move an operating arm that unlatches the rotary jaw for movement away from its latched position, and with the locking member shown in its unlatched position.

When the operating handle 240 is moved away from its nested, non-operated position toward its extended, operated position, the handle tab 250 is caused to move past the back wall opening 230 (compare the positions of the tab 250 as depicted in FIGS. 5 and 8). As will be explained shortly, this movement of the tab 250 past the back wall opening 230 is utilized by the rear mountable bracket, latch and linkage assembly 300 to "unlatch" the rotary latch subassembly 400 from latchingly engaging the strike 50.

Turning now to features of the "rear mountable modular assembly" or "bracket, latch and linkage" assembly 300, and referring to FIGS. 12–15, the mounting bracket 310 has a relatively flat, generally rectangular-shaped central region 312 with forwardly turned flanges 314 at opposite ends thereof, with a rearwardly turned flange 322 along one side thereof, and with a pair of spaced, forwardly turned flanges 324 along the opposite side thereof.

Figure 15:
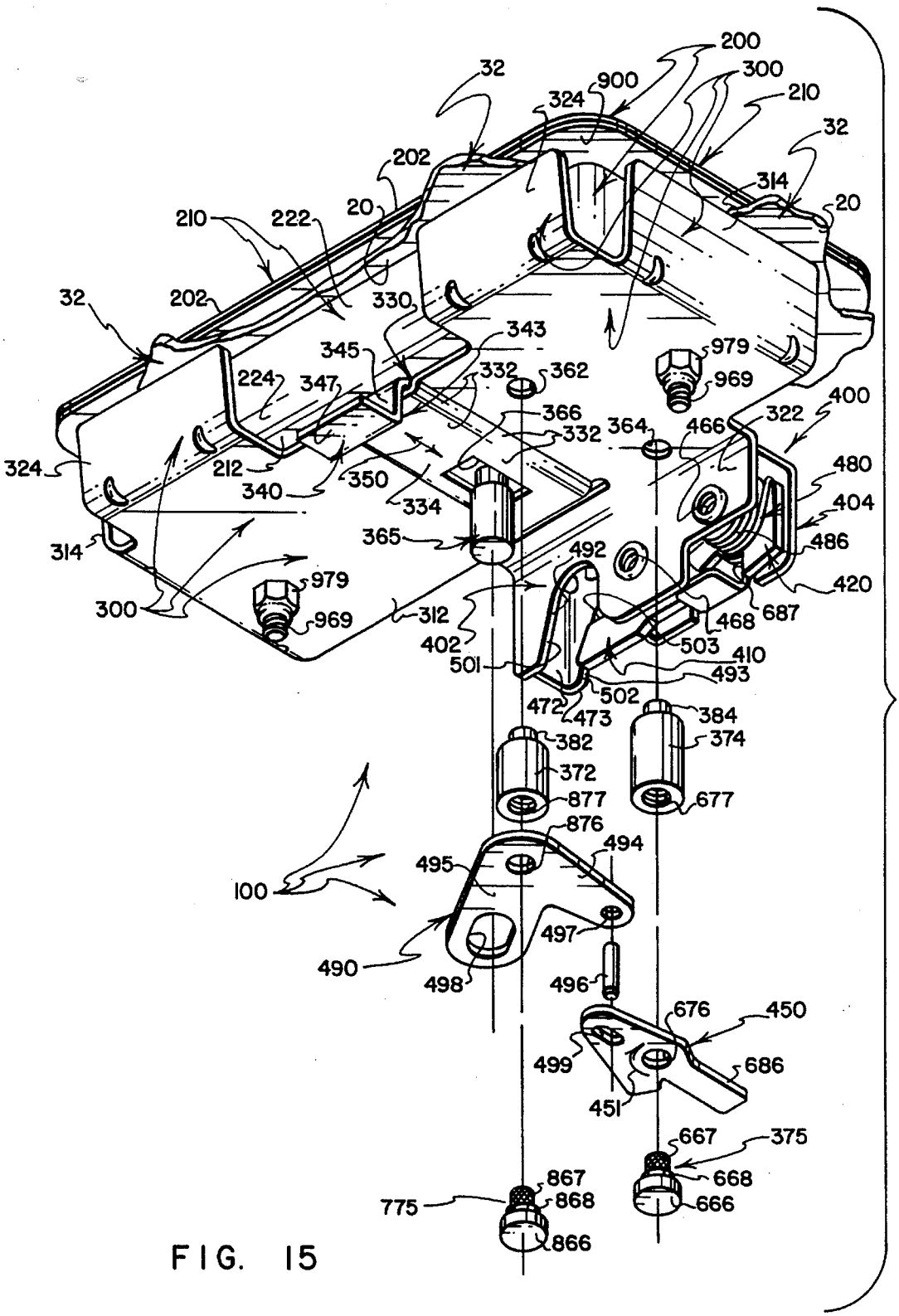
FIG. 15 is an exploded rear perspective view showing selected components of the unit of FIGS. 1–14, with some components separated so as to be depicted individually, and with other components shown assembled; and, FIGS. 16–19 are perspective views showing second, third, fourth and fifth rotary lock embodiments that incorporate features of the present invention.

Referring principally to FIGS. 14 and 15, an elongate slide channel 330 that parallels the forwardly turned flanges 314 at a location mid-way therebetween is defined by portions 332 of the flat central region 312 which extend out of a common plane that is occupied by other parts of the flat central region 312. The slide channel 330 has a substantially flat back wall 334 that is spaced behind the common plane that is occupied by other parts of the flat central region 312 sufficiently far to permit the slide 340 to translate freely along the length of the slide channel 330 (i.e., along a path of movement that is indicated generally by an arrow 350).

Referring to FIG. 14, tapered holes 362, 364 are formed through the central portion 312 of the mounting bracket 310 at spaced locations that are situated to one side of the slide channel 330. Referring to FIGS. 14 and 15, a pair of generally cylindrical spacers 372, 374 have reduced diameter front end regions 382, 384 that are of a proper size to be installed in the tapered holes 362, 364 and riveted to conform the end regions 382,384 to the shape of the tapered holes 362,364 to rigidly connect the spacers 372, 374 to the mounting bracket 310. Riveted ends 392, 394 of the spacers 372, 374 are depicted in FIG. 12.

Referring to FIGS. 14 and 15, a substantially rectangular slot 366 is formed through the back wall 334 of the slide channel 330. Referring to FIG. 13, a tapered hole 376 is formed through the slide 340 to receive a reduced diameter front end region 386 of a generally cylindrical member 365. The end region 386 is riveted to conform to the shape of the-tapered hole 376 to rigidly attach the cylindrical member 365 to the slide 340. In FIG. 12 the numeral 396 designates the riveted end region of the member 386.

Referring to FIG. 13, the member 365 has a rear end region 375 of relatively large diameter, and a central region 385 that has a diameter that is greater than the reduced diameter front end region 386 but smaller than the diameter of the relatively large diameter rear end region 375.. Shoulders 371, 373 provide transitions between the front and central diameters 386, 385, and between the central and rear diameters 385, 375. The shoulder 371 of the member 365 engages the rear surface of the slide 340 to cooperate with the riveted end region 396 in rigidly connecting the member 365 to the slide 340.

The relatively large rear diameter 375 of the member 365 is selected to be too large to pass through the rectangular slot 366 that is formed in the back wall 334 of the slide channel 330. By this arrangement, the shoulder 373 will be seen to engage the rear surface of the back wall 334 of the slide channel 330 in a manner that functions to retain the slide 340 in place within the slide channel 330 while permitting linear movement of the slide 340 along a path of travel 350, the extent of which movement is determined by the length of the slot 366 and the size of the central diameter 385 of the member 365. The space between the shoulders 371, 373 (i.e., the length of the central region 385) is chosen to be slightly greater than is the thickness of the back wall 334 to ensure that the slide 340 is sufficiently loosely confined by the shoulder 373 to permit free linear movement of the slide 340 along the prescribed path of movement 350 within the slide channel 330.

Figure 3:
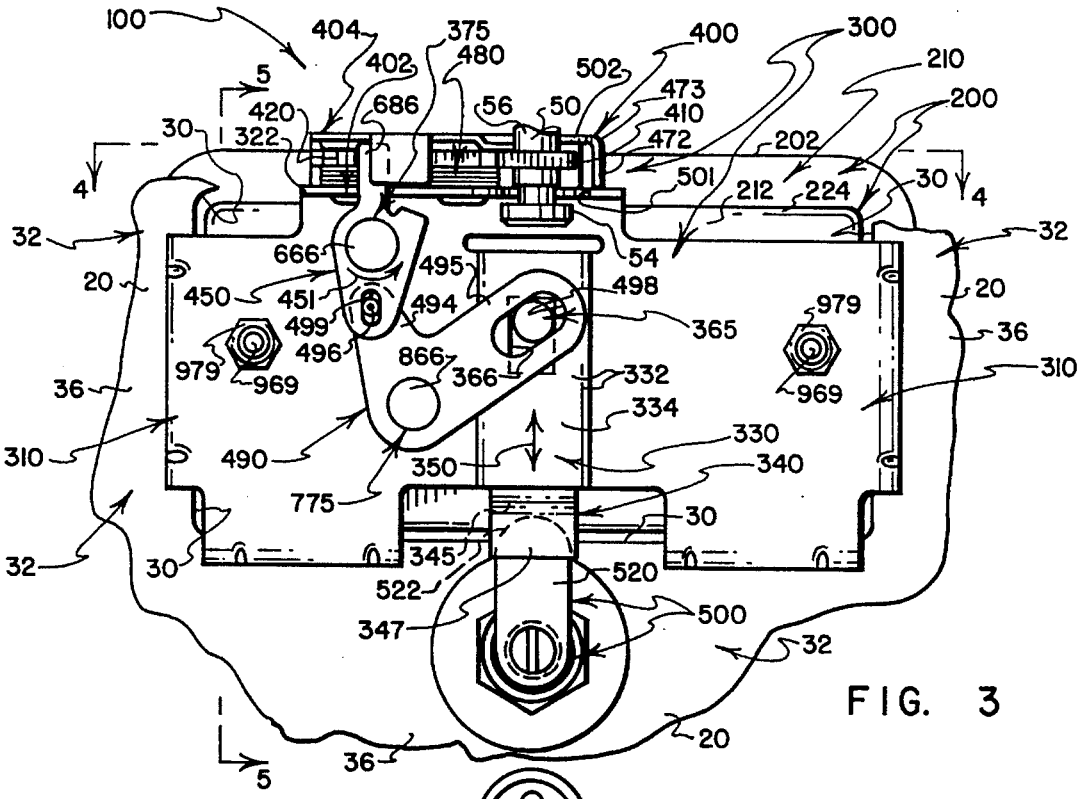
FIG. 3 is a bottom plan view of the unit, with relatively movable components thereof positioned as is depicted in FIG. 2, with a locking member shown in its locked position, and with portions of the strike and the closure broken away.

Referring to FIG. 13, the slide 340 has an integrally formed, forwardly turned end formation 341, and an integrally formed, rearwardly turned, "dog-legged" end formation 343. The forwardly turned end formation 341 is configured to extend through the back wall opening 230 for being engaged by the tab 250 of the operating handle 240. Referring to FIGS. 3, 5 and 12, the rearwardly turned, dog-legged end formation 343 is configured to extend rearwardly for a sufficient length to define a surface 345 that can be engaged by and end region 522 of a cam 520 of the lock assembly 500, and to define an extension 347 of the slide 340 that overlies the cam end region 522 when the cam 520 is in its "locked" position, as is depicted in FIGS. 3 and 5.

Turning to features of the rotary latch subassembly 400 (that, in the embodiment of FIG. 1–5, forms a part of the bracket, latch and linkage assembly 300), and referring to FIGS. 13 and 14, the sub-assembly 400 has what will be referred to as a "housing" that consists of first and second "housing side plates" 402, 404 which are rigidly held in spaced, parallel extending relationship by first and second spacers or bushings 406, 408. Reduced diameter end regions 426, 428 of the bushings 406, 408 extend through holes 416, 418 that are formed through the side plates 402, 404 and are expansively crimped, riveted or otherwise suitably enlarged by deformation to establish rigid connections with the side plates 402, 404.

Referring still to FIGS. 13 and 14, the bushings 406,408 are generally cylindrical, and provide stepped central regions that have relatively large diameter portions 436,438 and relatively smaller diameter portions 446, 448, respectively. The end and central regions 426, 436, 446 of the bushing 406 are concentric about a first transversely extending axis that is designated by the numeral 456. The end and central regions 428, 438, 448 of the bushing 408 are concentric about a second transversely extending axis that is designated by the numeral 458.

As an optional feature, internal threads 466, 468 preferably are formed within hollow interiors of the bushings 406, 408 to permit suitable threaded fasteners (not shown) to be connected thereto in the event that it is desired to mount the subassembly 400 in some manner other than on the mounting bracket 310. The provision of such threads is particularly useful in mounting the alternate latch subassembly embodiments 1400, 2400, 3400, 4400 (depicted in FIGS. 16, 17, 18 and 19, respectively).

Figure 16:
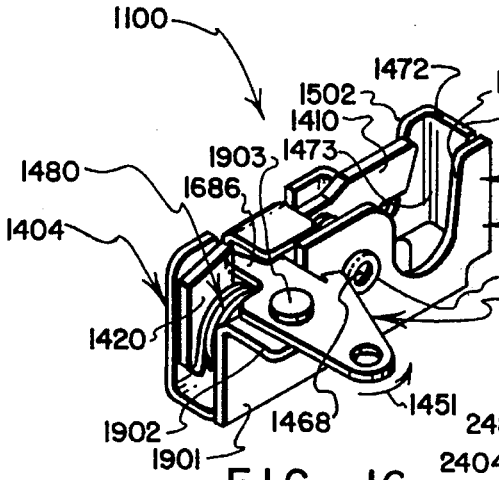
Figure 17:
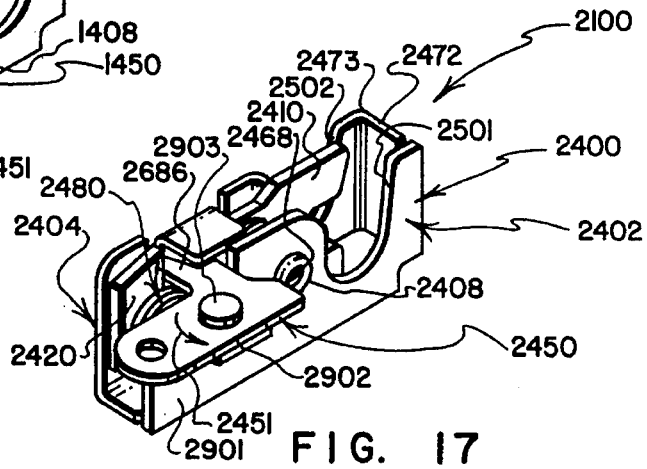
Figure 18:
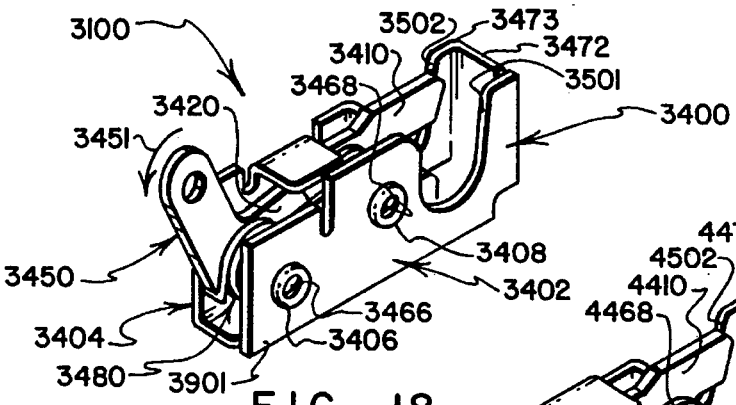
Figure 19:
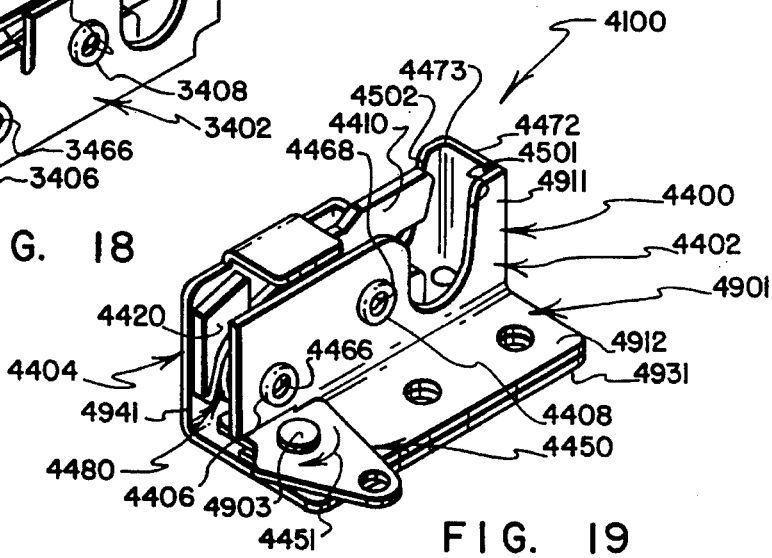

In the rotary latch subassembly embodiment 400, the first side plate 402 takes the form of a rearwardly turned flange 322 of the mounting bracket 310. In the alternative rotary latch subassembly embodiments 1400, 2400 and 3400 that are depicted in FIGS. 16, 17 and 18, respectively, corresponding first side plates 1402, 2402, 3402 take the form of elongate, substantially flat stampings 1901, 2901, 3901, respectively. In the alternative rotary latch subassembly embodiment 4400 that is depicted in FIG. 19, a corresponding first side plate 4402 is formed as one leg 4911 (of a pair of perpendicularly-extending legs 4911, 4912) of an elongate, angle-iron-shaped stamping 4901.

The stampings 1901, 2901 that are employed in the alternative rotary latch embodiments 1400, 2400 (depicted in FIGS. 16 and 17, respectively) have integrally formed, transversely extending tabs 1902, 2902 that carry pivot pins 1903, 2903 for pivotally mounting associated operating arms 1450, 2450, respectively. The stamping 3901 that is employed in the alternative rotary latch embodiment 3400 (see FIG. 18) has no corresponding tab for mounting its associated operating arm 3450; rather, the operating arm 3450 is formed as an integral extension of the rotary pawl 3420. The stamping 4901 that is employed in the alternative rotary latch embodiment 4400 (see FIG. 19) utilizes the leg 4912 of the stamping 4901, and an adjacent leg 4931 of a similarly configured angle-iron-shaped stamping 4941 (that defines the second housing side plate 4404) to mount a pivot pin 4903 which pivotally mounts an associated operating arm 4450. While the operating arms 1450, 2450 are positioned to pivot in the directions of arrows 1451, 2451 to effect unlatching movements of their associated rotary pawls 1420, 2420, the operating arm 4450 is positioned to pivot in the direction of arrow 4451 to effect unlatching movement of its associated rotary pawl 4420. Pivotal movement of the operating arm 3450 in the direction of arrow 3451 effects unlatching movement of its associated rotary pawl 3420.

Referring to FIGS. 13 and 14, the side plates 402, 404 define aligned first and second U-shaped notches 501, 502, respectively, that open rearwardly with respect to the closure 20 so that, as the closure 20 is moved toward its closed position, the resulting rearward movement of the side plates 402, 404 by the closure 20 will cause the central region 56 of the strike 50 to be received within the first and second U-shaped notches 501, 502 (see FIGS. 3). Referring to FIGS. 4, 10, 13 and 14, a cooperating third U-shaped notch 503 is formed in the rotary jaw 410, and functions in concert with the first and second U-shaped notches 501, 502 to receive and latchingly retain the central region 56 of the strike 50 therein when the closure 20 is closed.

A feature of the present invention resides in the utilization of the second U-shaped notch 502 (either alone or in concert with the first U-shaped notch 501) to define a strike engagement surface (or surfaces) that is (are) directly engageable by the central region 56 of the strike 50. If the first and second U-shaped notches 501, 502 are identically configured and positioned to extend in congruent alignment, a pair of congruently aligned strike engagement surfaces 492, 493 are defined by the notches 501, 502—which are engageable by the central region 56 of the strike 50 as the central region 56 moves into and is latchingly retained within the U-shaped notches 501, 502. If, on the other hand, the first U-shaped notch 501 is configured such that it is wider than the second U-shaped notch 502 (so that the surfaces that define the first notch 501 are positioned such that they cannot physically engage the strike 50), the only strike engagement surface that will be defined by either of the notches 501, 502 is the strike engagement surface 493 that is defined by the second U-shaped notch 502.

By always ensuring that the strike engagement surface 493 is defined by the second U-shaped notch 502 (regardless of whether an additional strike engagement surface 491 is defined by the first U-shaped notch 501), advantage will always be taken of the close proximity presence to the second notch 502 (and to the strike engagement surface 493) of a transversely extending reinforcing flange 472 that is formed integrally with the second side plate 404 near one end thereof. A tight radius bend 473 connects the flange 472 to a narrow portion 474 (see FIG. 1 and 2) of the second side plate 404 that extends along one side of the second notch 502 (and that defines the strike engagement surface 493). The close proximity presence of the transversely extending flange 472 and the bend 473 to the second notch 502 (and to the strike engaging surface 493 that is defined by the second notch 502) strengthens and rigidifies the second housing side plate 404 in the critical area adjacent the strike engaging surface 493. In preferred practice; what is mean by the term "close proximity presence" in describing the close proximity of the transversely extending flange 472 to the second notch 502 is exemplified by the arrangement that is depicted in the drawings wherein it will be seen that the distance by which the notch 502 is spaced from the flange 472 is clearly less than the distance by which the housing side plates 402, 404 are spaced apart.

While the second U-shaped notch 502 could be configured such that it is wider than the first U-shaped notch 501 (whereby the only strike engagement surface that would be defined by either of the notches 501, 502 is the strike engagement surface 492 that is defined by the first U-shaped notch 501), this option does not conform to the preferred practice of the present invention unless the first housing side plate 402 is provided with a transversely extending flange (not shown) that is substantially identical to the depicted flange 472, but which extends from the first side plate 402 toward the second side plate 404 to bridge the space therebetween (instead of extending from the second side plate 404 toward the first side plate 402 to bridge the space therebetween, as does the depicted flange 472).

Referring to FIG. 14, housed between the side plates 402, 404 are the rotary jaw 410 and a rotary pawl 420. The rotary jaw 410 has a mounting hole 411 that receives the bushing diameter 448 therein in a slip fit to mount the rotary jaw 410 on the bushing 408 for limited angular movement about the transversely extending axis 458. The rotary pawl 420 has a mounting hole 421 that receives the bushing diameter 446 therein in a slip fit to mount the rotary pawl 420 on the bushing 406 for limited angular movement about the transversely extending axis 456.

Also housed between the side plates 402,404 is a torsion coil spring 480 that has a first coil 486 that extends about the diameter 436 of the bushing 406, and a second coil 488 that extends about the diameter 438 of the bushing 408. An end 482 of the spring 480 engages the rotary jaw 410 for biasing the rotary jaw 410 in a direction of angular movement about the axis 458 that is indicated by an arrow 483. An opposite end 484 of the spring 480 engages the rotary pawl 420 for biasing the rotary pawl 420 in a direction of angular movement about the axis 456 that is indicated by an arrow 485.

Referring to FIGS. 7 and 10, the rotary jaw 410 and the rotary pawl 420 are provided with engageable formations 486, 487, respectively, that cooperate to "preliminarily latch" the rotary jaw 410 in engagement with the central region 56 of the strike 50 after the strike 50 has moved only a short distance into the aligned first and second U-shaped notches 501,502 during movement of the closure 20 toward its closed position.

Figure 4:
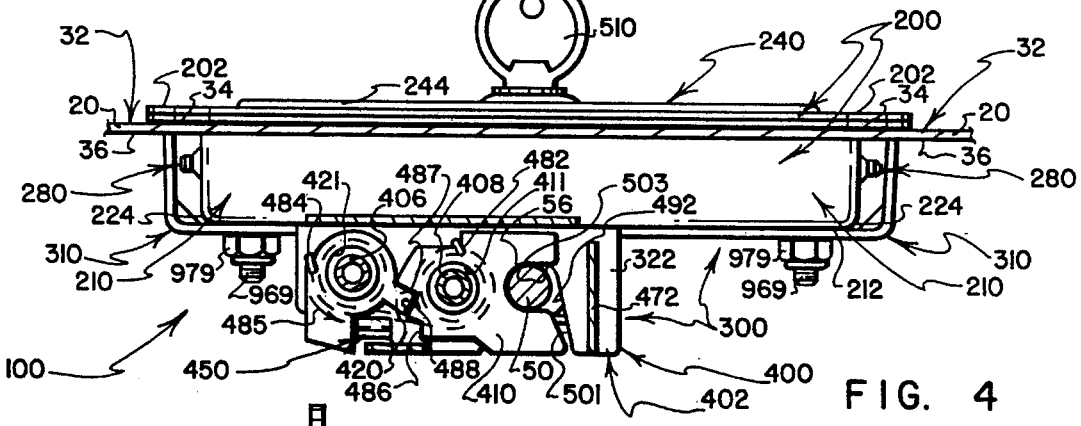
FIGS. 4 and 5 are sectional views as seen from planes indicated by lines 4—4 and 5—5 in FIG. 3, with relatively movable components of the unit positioned as is depicted in FIGS. 2 and 3, but with a key inserted in a lock cylinder of the unit.

Referring to FIG. 4, the rotary jaw 410 and the rotary pawl 420 also are provided with engageable formations 488, 487, respectively, that cooperate to "fully latch" the rotary jaw 410 in engagement with the central region 56 of the strike 50 after the strike 50 has moved as far as it is going to move into the aligned first and second U-shaped notches 501, 502 as the closure 20 is moved to its fully closed position. When the engageable formations 487, 488 are engaged (as is depicted in FIG. 4), the rotary jaw 410 is prevented by the rotary pawl 420 from executing unlatching movement until the rotary pawl 420 is rotated about the axis 456 to a pawl-releasing position wherein the engageable formations 487, 488 disengage to permit the rotary jaw 410 to rotate away from its fully latched position toward its unlatched position wherein the strike 50 is free to move out of the third U-shaped notch 503 that is defined by the rotary jaw 410. This type of pawl-controlled jaw latching action is well known to those who are skilled in the art, and is further illustrated and described in the patents that are identified above.

To move the rotary pawl 420 in opposition to the action of the torsion coil spring 480 (i.e., in a direction opposite the arrow 485) from a pawl-retaining position (depicted in FIG. 4) to a pawl-releasing position (depicted in FIG. 7), the operating arm 450 is pivotally mounted by a pivot pin 375 (see FIGS. 14 and 15) that connects with the cylindrical spacer 374. The pivot pin 375 has a relatively large diameter head 666, a relatively small diameter knurled end formation 667., and a relatively intermediate diameter central region 668. The central region 668 extends through a hole 676 that is formed through the operating arm 450 to mount the operating arm 450 on the pivot pin 375 for angular movement relative thereto. The small diameter knurled end formation 667 is pressed into a hollow end region 677 (see FIG. 15) of the spacer 374. By this arrangement the rotary pawl 420 is mounted on the mounting bracket 310 for being pivoted within a limited range of angular movement about the axis of the spacer 374.

Referring to FIG. 15, the operating arm 450 has a projection 686 that extends across the housing side plate 402 to engage an operating formation 687 that is defined by the pawl 420. When the operating arm 450 is pivoted in the direction of arrow 451, the projection 686 engages the formation 687 to pivot the pawl 420 in opposition to the action of the torsion coil spring 480 (i.e., in a direction opposite arrow 485 (see FIGS. 7 and 10) to move the pawl 420 from its jaw-retaining position (shown in FIG. 4) to its jaw-releasing position (shown in FIG. 7).

To pivot the pawl 420 in the manner just described, an L-shaped link 490 is pivotally mounted (by a pivot pin 775 that is identical to the pivot pin 375) on the spacer 372. The pivot pin 775 has a relatively large diameter head 866, a relatively small diameter knurled end formation 867, and a relatively intermediate diameter central region 868. The central region 868 extends through a hole 876 that is formed through the L-shaped link 490 to mount the L-shaped link 490 on the pivot pin 775 for angular movement relative thereto. The small diameter knurled end formation 867 is pressed into a hollow end region 877 (see FIG. 15) of the spacer 372. By this arrangement the L-shaped link 490 is mounted on the mounting bracket 310 for being pivoted within a limited range of angular movement about the axis of the spacer 372.

Referring to FIG. 15, the L-shaped arm 490 has angularly arrayed arm portions 494, 495. A roll pin 496 is pressed into a hole 497 formed near the end of the arm portion 494. The roll pin 496 extends through a slot 499 that is formed in the operating arm 450. The cylindrical member 365 extends through a slot 498 that is formed near the end of the arm portion 495. By this arrangement, linear movement of the cylindrical member 365 by the slide 340 along the path of movement 350 that is defined by the slide path 330 causes the L-shaped arm 490 to pivot about the axis of the spacer 372; and, as the L-shaped arm 490 is caused to pivot about the axis of the spacer 372, the connection that is established by the roll pin 496 between the L-shaped arm and the operating arm 450 causes the operating arm 450 to pivot about its associated pivot pin 375.

Figure 2:
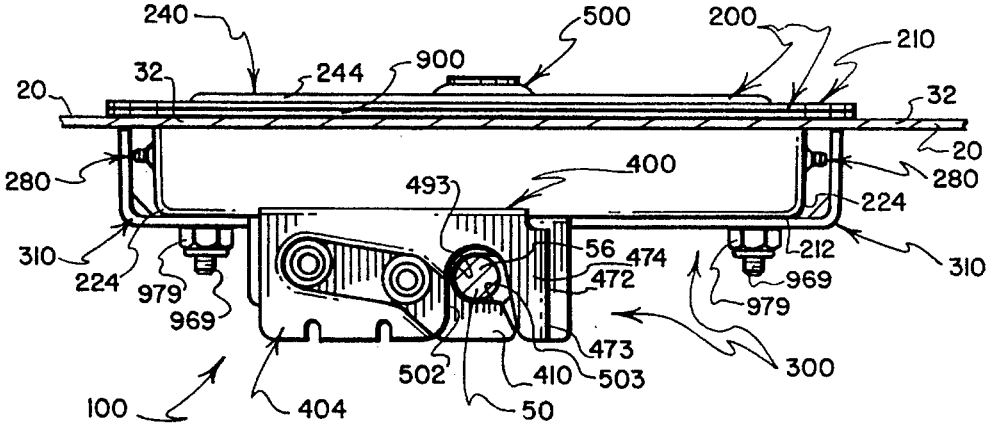
FIG. 2 is a side elevational view of the unit of FIG. 1, with the rotary jaw shown latchingly engaging portions of the strike, and with closure portions that extend adjacent the unit being shown in cross section.

Referring to FIGS. 3, 5, 8 and 12, to mount the unit 100 on the closure 20, a generally rectangular opening 30 is formed through the front wall plate 32 of the closure. Referring to FIGS. 1 and 2, the front wall plate 32 has an "outer" or "front" surface 34, and an "inner" or "back" surface 36. During installation of the assembly 200, side walls 222 of the pan-shaped housing 210 are positioned to extend through the closure opening 30, and a mounting flange 202 of the housing 210 is positioned to closely overlie such portions of the closure 20 as extend perimetrically about the opening 30. A gasket 900 (see FIG. 13) preferably is provided for being sandwiched between the mounting flange 202 and the front wall surface portions 28.

Installation of the assembly 200 is completed by causing the mounting flange 202 to be securely clamped toward a position of engagement with the closure portions 28 (i.e., to securely clamp the gasket 900 between the mounting flange 202 and the front wall surface portions 28), with needed clamping force being provided by threaded studs 969 that project rearwardly from the back wall 212 of the pan-shaped housing 210—and by lock nuts 979 that are threaded onto (and tightened in place on) the studs 969 after the studs 969 have been inserted through mounting holes 989 (see FIGS. 13 and 14) that are formed through the flat central region 312 of the mounting bracket 310.

As the nuts 979 are tightened in place on the studs 969, the forwardly extending flanges 314, 324 of the mounting bracket 310 are clamped toward and tightly into engagement with the back surface 36 of the front wall plate 32 of the closure 20. By this arrangement, the assemblies 200, 300 are quickly, easily and yet securely fastened in place on the closure, with proper alignment and registry of the assemblies 200,300 being ensured.

So long as the rotary jaw 410 of the unit 100 is in its unlatched position (depicted in FIGS. 1 and 7), the rotary jaw 410 always can be slammed into latching engagement with the strike 50. This is true regardless of how other relatively movable components of the unit 100 may be positioned. As the rotary jaw 410 receives the strike 50 within its third U-shaped notch 503, and as the strike 50 moves into the aligned first and second U-shaped notches 501, 502 of the housing side plates 402, 404, the strike 50 becomes cooperatively confined by the combined action of the first, second and third notches 501, 502, 503. When the strike 50 reaches the position that is depicted in FIG. 10, the rotary pawl 420 and the rotary jaw 410 become "preliminarily latched" (i.e., the engagement formations 486, 487 engage to prevent unlocking of the rotary jaw 410). When the strike 50 reaches the fully latched position depicted in FIG. 4, the engagement formations 487, 488 engage to fully lock the closure 20 in its closed position.

So long as the key-locking assembly 500 positions the cam 520 in its "unlocked" position, as is depicted in FIGS.

6, 8, 9 and 11, movement of the slide 340 within the slide channel 330 will not be impeded by the cam 520—hence, the operating handle 240 can be pivoted out of its nested, non-operated position (shown in FIG. 5) to its extended, operated position (shown in FIG. 8) to cause the tab 250 to engage the forwardly extending projection 341 of the slide 340, whereby the slide 340 is caused to move within the slide channel 330, the cylindrical member 365 is caused to pivot the L-shaped arm 490, and the L-shaped arm 490 is caused to operate the operating arm 450 to pivot the rotary pawl 420 away from its normal jaw-retaining position (shown in FIG. 4) toward its jaw-releasing position (shown in FIG. 7) to release the pawl formation 487 from engaging either of the jaw formations 488, 486, whereupon the rotary jaw 420 pivots under the influence of the spring 480 away from its latched position (shown in FIG. 4) to its unlatched position (shown in FIG. 7) to release the strike 50.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A rotary latch for mounting on a closure for releasably retaining the closure in a closed position by latchingly engaging a suitably configured strike formation, comprising:

a) elongate housing means, including:

i) an elongate, generally rectangular first housing side plate having opposed end regions near opposite ends of the length thereof, with the first housing side plate defining a first U-shaped notch located near one of the opposed end regions of the first housing side plate, and defining a substantially flat first side wall portion that extends along the length of the first housing side plate from the other of the opposed end regions thereof to the first U-shaped notch;

ii) an elongate, generally rectangular second housing side plate having opposed end regions near opposite ends of the length thereof with one of the opposed end regions of the second housing side plate overlying said one end region of the first housing side Plate, with the second housing side plate defining a second U-shaped notch located near said one end region of the second housing side plate, and defining a substantially flat second side wall portion that extends along the length of the second housing side plate from the other of the opposed end regions thereof to the second U-shaped notch to overlie the first side wall portion of the first housing side plate, with the second U-shaped notch being configured and positioned by the second housing side plate to substantially align with the first U-shaped notch;

iii) spacer means for extending transversely between and for rigidly connecting with the first and second elongate side wall portions for holding in substantially parallel-extending overlying relationship the first and second housing side plates, with the spacer means comprising only a first spacer and a second spacer, with the first spacer extending along a first transverse axis that intersects each of the first and second overlying side wall portions at a location that is relative near to said opposite end regions of the first and second housing side plates, with the second spacer extending along a second transverse axis that intersects each of the first and second overlying side wall portions at a location that is substantially midway between the opposite ends of the first and second housing side plates, and, with the first and second transverse axes extending substantially parallel to each other in a direction that extends transversely between the overlying side wall portions of the first and second housing side plates;

b) rotary means comprising only two rotary latching elements each of which is carried by a separate one of the first and second spacers, namely a rotary jaw and a rotary pawl that extend substantially within a common plane located between the overlying side wall portions of the first and second housing side plates, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with an operating arm being provided for moving the rotary pawl to release the rotary jaw from its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation;

c) wherein the first and second U-shaped notches open generally in a direction that is substantially opposite to a direction of travel extending along a path of travel that is followed by the closure in moving away from a slightly open position toward the closed position, with each of the first and second notches being defined, at least in part, by a pair of spaced-apart side surfaces that extend along opposite sides of said path of travel and that are smoothly interconnected by an associated curved surface, and with at least one of the associated curved surfaces having a radius of curvature that substantially matches the radius of curvature of a generally cylindrical strike formation portion that is received within the first, second and third U-shaped notches when the strike formation is latchingly engaged by the rotary latch;

d) wherein a selected one of the first and second housing side plates has a strike engagement surface that is configured to be directly engaged by a strike formation that is received within the first, second and third U-shaped notches, which strike engagement surface is defined by at least a portion of a chosen one of the pair of spaced-apart side surfaces of the U-shaped notch of the selected one of the side plates, which chosen one of the side surfaces is the side surface that is located farthest from the second transverse axis about which the rotary jaw is rotatable; and, e) housing side plate reinforcement means for strengthening and enhancing the rigidity of said selected one of the first and second housing side plates by providing in close proximity presence to the U-shaped notch of the selected one of the side plates a transversely extending flange:

i) that is formed integrally with said selected housing side plate at said one end thereof;

ii) that substantially parallels the first and second transversely extending axes so as to transversely bridge between the overlying said one end regions of the first and second housing side plates;

iii) that is connected by a relatively small radius right angle bend to such portions of said selected housing side plate as define the strike engagement surface; and, iv) with said flange and said bend being located in close proximity to the strike engagement surface so as to cooperate in rigidifying and strengthening said portions of said selected housing side plate that define the strike engagement surface.

2. The latch of claim 1, wherein:

a) the third U-shaped notch is defined by a portion of the rotary jaw that moves to sufficiently align the directions in which the first, second and third U-shaped notches open when the rotary jaw is in its unlatched position to permit movement of the strike formation into and out of the first, second and third U-shaped notches, and to cause the first, second and third U-shaped notches to progressively close about portions of a strike formation that are received therein as the rotary jaw is moved toward its latched position during closing movement of the closure on which the rotary latch is mounted; and, b) the rotary jaw and the rotary pawl are configured i) to permit the rotary pawl to effect a preliminary form of latching engagement with the rotary jaw that partially restricts the range of angular movement through which the rotary jaw can rotate in moving away from its fully latched position, and ii) to permit the rotary pawl to effect a fully latched form of latching engagement with the rotary jaw wherein the rotary jaw is retained in a fully latched position and is permitted to execute substantially no angular movement while being retained in the fully latched position.

3. The latch of claim 1 wherein the operating arm is connected to a chosen one of the first and second housing side plates for engaging and moving the rotary pawl away from its jaw-retaining position toward its jaw-releasing position to "unlatch" the rotary jaw for movement from its latched position toward its unlatched position.

4. The latch of claim 1 wherein said transversely extending flange formed integrally with said selected housing side plate is located so closely to said strike engagement surface that the distance by which the transversely extending flange is spaced from said strike engagement surface is less than the distance that is maintained by the spacer means in holding the first and second elongate side wall portions in said parallel-extending overlying relationship.

5. The latch of claim 1 wherein said transversely extending flange is configured to bridge between the first and second housing side plates in a manner that substantially closes one end region of said elongate housing means.

6. A rotary latch for mounting on a closure for releasably retaining the closure in a closed position by latchingly engaging a suitably configured strike formation, comprising:

a) elongate housing means, including:

i) an elongate, generally rectangular first housing side plate having opposed end regions near opposite ends of the length thereof, with the first housing side plate defining a first U-shaped notch located near one of the opposed end regions of the first housing side plate, and defining a substantially flat first side wall portion that extends along the length of the first housing side plate from the other of the opposed end regions thereof to the first U-shaped notch;

ii) an elongate, generally rectangular second housing side plate having opposed end regions near opposite ends of the length thereof with one of the opposed end regions of the second housing side plate overlying said one end region of the first housing side plate, with the second housing side plate defining a second U-shaped notch located near said one end region of the second housing side plate, and defining a substantially flat second side wall portion that extends along the length of the second housing side plate from the other of the opposed end regions thereof to the second U-shaped notch to overlie the first side wall portion of the first housing side plate, with the second U-shaped notch being configured and positioned by the second housing side plate to substantially align with the first U-shaped notch;

iii) spacer means for extending transversely between and for for rigidly connecting with the first and second elongate side wall portions for holding in substantially parallel-extending overlying relationship the first and second housing side plates, with the spacer means comprising only a first spacer and a second spacer, with the first spacer extending along a first transverse axis that intersects each of the first and second overlying side wall portions at a location that is relative near to said opposite end regions of the first and second housing side plates, with the second spacer extending along a second transverse axis that intersects each of the first and second overlying side wall portions at a location that is substantially mid-way between the opposite ends of the first and second housing side plates, and, with the first and second transverse axes extending substantially parallel to each other in a direction that extends transversely between the overlying side wall portions of the first and second housing side plates;

b) rotary means comprising only two rotary latching elements each of which is carried by a separate one of the first and second spacers, namely a rotary jaw and a rotary pawl that extend substantially within a common plane located between the overlying side wall portions of the first and second housing side plates, with the rotary jaw being connected to the second spacer and being rotatable through a limited range of angular movement about the second transverse axis between latched and unlatched positions but being spring-biased toward its unlatched position, with the rotary pawl being connected to the first spacer and being movable relative to the housing about the first transverse axis between jaw-retaining and jaw-releasing positions to selectively release and retain the rotary jaw in its latched position but being spring-biased to move the rotary pawl toward its jaw-retaining position as the rotary jaw moves to its latched position, with an operating arm being provided for moving the rotary pawl to release the rotary jaw from its latched position, with the rotary jaw defining a third U-shaped notch that is configured to cooperate with the first and second U-shaped notches to concurrently receive and to latchingly retain within the confines of the first, second and third U-shaped notches a suitably configured strike formation when the rotary latch latchingly engages the strike formation;

c) wherein the first and second U-shaped notches open generally in a direction that is substantially opposite to a direction of travel extending along a path of travel that is followed by the closure in moving away from a slightly open position toward the closed position, with each of the first and second notches being defined, at least in part, by a pair of spaced-apart side surfaces that extend along opposite sides of said path of travel and that are smoothly interconnected by an associated curved surface, and with at least one of the associated curved surfaces having a radius of curvature that substantially matches the radius of curvature of a generally cylindrical strike formation portion that is received within the first, second and third U-shaped notches when the strike formation is latchingly engaged by the rotary latch;

d) wherein the first housing side plate has a first strike engagement surface that is configured to be directly engaged by a strike formation that is received within the first, second and third U-shaped notches, with the first strike engagement surface being defined by at least a portion of a chosen one of the pair of spaced-apart side surfaces of the first U-shaped notch of the first housing side plate, which chosen one of the side surfaces is the side surface that is located farthest from the second transverse axis about which the rotary jaw is rotatable;

e) wherein the second housing side plate has a second strike engagement surface that is configured to be directly engaged by a strike formation that is received within the first, second and third U-shaped notches, with the second strike engagement surface being defined by at least a portion of a chosen one of the pair of spaced-apart side surfaces of the second U-shaped notch of the second housing side plate, which chosen one of the side surfaces is the side surface that is located farthest from the second transverse axis about which the rotary jaw is rotatable; and, f) housing side plate reinforcement means for strengthening and enhancing the rigidity of a selected one of the first and second housing side plates in the immediate vicinity of the associated one of the first and second strike engagement surfaces by providing in close proximity to said associated strike engagement surface a transversely extending flange:

i) that is formed integrally with said selected housing side plate;

ii) that substantially parallels the first and second transversely extending axes so as to transversely bridge between the overlying said one end regions of the first and second housing side plates;

iii) that is connected by a relatively small radius right angle bend to such portions of said selected housing side plate as define the strike engagement surface; and, iv) with said flange and said bend being located in close proximity to the strike engagement surface so as to cooperate in rigidifying and strengthening said portions of said selected housing side plate that define the strike engagement surface.

7. The latch of claim 6 wherein:

a) the third U-shaped notch is defined by a portion of the rotary jaw that moves to sufficiently align the directions in which the first, second and third U-shaped notches open when the rotary jaw is in its unlatched position to permit movement of the strike formation into and out of the first, second and third U-shaped notches, and to cause the first, second and third U-shaped notches to progressively close about portions of a strike formation that are received therein as the rotary jaw is moved toward its latched position during closing movement of the closure on which the rotary latch is mounted; and, b) the rotary jaw and the rotary pawl are configured i) to permit the rotary pawl to effect a preliminary form of latching engagement with the rotary jaw that partially restricts the range of angular movement through which the rotary jaw can rotate in moving away from its fully latched position, and ii) to permit the rotary pawl to effect a fully latched form of latching engagement with the rotary jaw wherein the rotary jaw is retained in a fully latched position and is permitted to execute substantially no angular movement while being retained in the fully latched position.

8. The latch of claim 6 wherein the operating arm is connected to a chosen one of the first and second housing side plates for engaging and moving the rotary pawl away from its jaw-retaining position toward its jaw-releasing position to "unlatch" the rotary jaw for movement from its latched position toward its unlatched position.

9. The latch of claim 6 wherein said transversely extending flange formed integrally with said selected housing side plate is located so closely to said associated strike engagement surface that the distance by which the transversely extending flange is spaced from said associated strike engagement surface is less than the distance that is maintained by the spacer means in holding the first and second elongate side wall portions in said parallel-extending overlying relationship.

10. The latch of claim 6 wherein said transversely extending flange is configured to bridge between the first and second housing side plates in a manner that substantially closes one end region of said elongate housing means.

* * * * *